US006154235A

United States Patent [19]

Fukumoto et al.

[11] Patent Number: 6,154,235

[45] Date of Patent: Nov. 28, 2000

[54] ACOUSTIC LIQUID EJECTOR AND PRINTER APPARATUS INCORPORATING THE EJECTOR

[75] Inventors: Hiroshi Fukumoto; Jyunichi Aizawa; Hiromu Narumiya, all of Tokyo, Japan

[73] Assignee: Mitsubishi Denki Kabushiki Kaisha, Tokyo, Japan

[21] Appl. No.: 09/044,792

[22] Filed: Mar. 20, 1998

[30] Foreign Application Priority Data

Apr. 3, 1997 [JP] Japan ..... 9-085037

[51] Int. Cl.[7] ..... B41J 3/04

[52] U.S. Cl. ..... 347/46; 347/47

[58] Field of Search ..... 347/46, 47, 75

[56] References Cited

U.S. PATENT DOCUMENTS 4,308,547 12/1981 Lovelady et al. ..... 346/140 R
4,370,662 1/1983 Hou et al. ..... 347/75
4,751,530 6/1988 Elrod et al. ..... 346/140 R
4,959,674 9/1990 Khuri-Yakub et al. .

FOREIGN PATENT DOCUMENTS

0550148 A2 7/1993 European Pat. Off. .
0572241 A2 12/1993 European Pat. Off. .
2-164543 6/1990 Japan .

*Primary Examiner*—Joan Pendegrass
*Attorney, Agent, or Firm*—Leydig, Voit & Mayer, Ltd.

[57] ABSTRACT

A liquid ejector increases the density of acoustic energy to eject droplets efficiently. Acoustic waves are introduced in generally planar form from a piezoelectric transducer into a liquid ink in a reservoir and are reflected from a reflecting wall of the reservoir. The reflecting wall defines a parabola in cross section. An ejection opening is located near a focal point of the parabola, opposite the transducer. The acoustic waves focus at the ejection opening, increasing the density of the acoustic energy in the ink at the ejection opening. Thus, ink droplets are ejected efficiently from the ejection opening.

20 Claims, 13 Drawing Sheets

ACOUSTIC LIQUID EJECTOR AND PRINTER APPARATUS INCORPORATING THE EJECTOR

BACKGROUND OF THE INVENTION

1. Field of the Invention

The present invention relates to a liquid ejector and, more particularly, to a head for use in an ink jet printer.

2. Description of the Background Art

Historically, an ink jet printer head has employed a process for introducing acoustic waves generated from a piezoelectric transducer into ink to eject droplets of ink or sprays of ink using the acoustic energy of the acoustic waves. A head for increasing the density of the acoustic energy by focusing acoustic waves to enhance the efficiency of ink ejection has been considered.

FIG. 19 is a cutaway view in perspective of a conventional ink jet printer head. FIG. 20 is a cross-sectional view taken along the xz plane of FIG. 19.

An ink tank 110 has a recess for storing ink 130 and having a bottom surface serving as a reflecting surface 111. The reflecting surface 111 defines a parabola in cross section taken along the xz plane. A plurality of piezoelectric transducers 120 arranged in two rows, with the piezoelectric transducers 120 in each row arranged in the y direction, are disposed over (in the positive x direction of) the recess of the ink tank 110. A gap between the two rows defines an ejection opening 119. Each of the piezoelectric transducers 120 comprises an upper electrode 121 and a lower electrode 122 which are connected to an alternating-current power supply 125 through interconnect lines 123 and 124, respectively. For purposes of illustration, the interconnect lines 124 and the alternating-current power supply 125 are not shown in FIG. 19.

The piezoelectric transducers 120 introduce acoustic waves 126 that vibrate in a thickness-longitudinal direction into the ink 130. The acoustic waves 126 travel in the recess in the negative x direction, and then are reflected from the reflecting surface 111. If the ejection opening 119 is provided adjacent the focal point 112 of the parabola defined by the reflecting surface 111, the acoustic waves 126 are focused on the focal point 112 in an in-phase condition to increase the density of the acoustic energy of the acoustic waves 126 at the ejection opening 119, achieving efficient ejection of an ink droplet 131 from the ejection opening 119.

The piezoelectric transducers 120 adjacent to each other are independently driven to eject the ink droplet 131 at a desired position on the y-axis in the ejection opening 119.

The conventional head having the above described structure presents following drawbacks:

(1) The size of the ejection opening 119 which is defined as a gap between the two rows of piezoelectric transducers 120 is difficult to control with high accuracy.

(2) Since the piezoelectric transducers 120 are provided adjacent the ejection opening 119, the acoustic waves 126 focused in the ejection opening 119 and the vibration of the piezoelectric transducers 120 are not always in phase and are liable to attenuate each other.

(3) The interconnect lines 124 required for the lower electrodes 122 are difficult to install.

(4) An intake passage for supplying the ink 130, which is generally provided in the bottom of the recess for storing the ink 130, must be formed in a position so as not to impair the configuration of the reflecting surface 111. The intake passage is easy to form so as to extend in the y direction, but impairs the reflecting surface 111 if formed so as to extend in the z direction.

(5) The acoustic waves 126 travel once in the negative x direction. Then, the paths of the acoustic waves 126 with components oriented in the positive x direction are reflected at acute angles from the reflecting surface 111. Thus, a large amount of acoustic energy transmitted through the reflecting surface 111 is lost.

SUMMARY OF THE INVENTION

According to a first aspect of the present invention, a liquid ejector comprises: a reservoir for storing a liquid to be ejected, the reservoir including a reflecting wall and an ejection opening for ejecting the liquid; and an acoustic wave source provided on the reservoir in spaced apart relation to the ejection opening for introducing acoustic waves into the liquid, wherein the acoustic waves are reflected from the reflecting wall to focus at the ejection opening.

Preferably, according to a second aspect of the present invention, in the liquid ejector of the first aspect, the acoustic waves introduced from the acoustic wave source are reflected at an angle greater than 90 degrees from the reflecting wall and travel in the liquid toward the ejection opening.

Preferably, according to a third aspect of the present invention, in the liquid ejector of the second aspect, at least part of the reflecting wall defines in cross section a parabola having an axis parallel to a first direction oriented from the acoustic wave source to the ejection opening, and the ejection opening is positioned at the focal point of the parabola.

Preferably, according to a fourth aspect of the present invention, in the liquid ejector of the third aspect, the reflecting wall defines a paraboloid of revolution having an axis of revolution parallel to the first direction, and the ejection opening is positioned at the focal point of the paraboloid.

Preferably, according to a fifth aspect of the present invention, in the liquid ejector of the fourth aspect, the reservoir further includes a planar surface parallel to the first direction.

Preferably, according to a sixth aspect of the present invention, in the liquid ejector of the third aspect, the acoustic wave source extends in a second direction perpendicular to the first direction; and the reflecting wall defines the parabola in cross section perpendicular to the second direction.

Preferably, according to a seventh aspect of the present invention, in the liquid ejector of the sixth aspect, the acoustic wave source defines a recess opposed to the ejection opening in cross section perpendicular to a third direction perpendicular to both of the first and second directions.

Preferably, according to an eighth aspect of the present invention, in the liquid ejector of the first aspect, at least part of the reflecting wall defines an arc of an ellipse in cross section, and the acoustic wave source and the ejection opening are positioned respectively at different focal points of the ellipse.

Preferably, according to a ninth aspect of the present invention, in the liquid ejector of the first aspect, the acoustic wave source comprises: a vibrator; and a vibrating plate between the vibrator and the reservoir.

Preferably, according to a tenth aspect of the present invention, in the liquid ejector of the ninth aspect, the vibrating plate has an acoustic impedance at an intermediate level between the acoustic impedance of the liquid and the acoustic impedance of the vibrator.

Preferably, according to an eleventh aspect of the present invention, the liquid ejector of the third aspect further comprises: a nozzle plate including an opening having a diameter less than the diameter of the ejection opening.

Preferably, according to a twelfth aspect of the present invention, the liquid ejector of the first aspect further comprises: an intake passage provided adjacent to the acoustic wave source in the reflecting wall for supplying the liquid, wherein the ejection opening comprises a plurality of ejection openings all provided in the reservoir, and the intake passage is provided commonly for the plurality of ejection openings.

According to a thirteenth aspect of the present invention, a printer apparatus comprises: a liquid ejector including a reservoir for storing a liquid to be ejected, the reservoir including a reflecting wall and an ejection opening for ejecting the liquid, and an acoustic wave source provided on the reservoir in spaced apart relation to the ejection opening for introducing acoustic waves into the liquid, wherein the acoustic waves are reflected from the reflecting wall to focus at the ejection opening; and a moving mechanism for moving paper opposed to the ejection opening relative to the ejection opening, wherein the liquid is applied to the paper for printing on the paper.

In accordance with the liquid ejector of the first aspect of the present invention, the acoustic waves traveling toward the ejection opening come to focus to provide high acoustic energy, causing the liquid to be efficiently ejected from the ejection opening. Additionally, since the ejection opening and the acoustic wave source are spaced apart from each other, the acoustic waves focused at the ejection opening and the acoustic wave source do not interfere with each other.

The acoustic waves traveling in the liquid is longitudinal waves. In accordance with the liquid ejector of the second aspect of the present invention, the acoustic waves are reflected at an angle greater than 90 degrees from the reflecting wall, resulting in efficient reflection. This further increases the acoustic energy provided by the acoustic waves being focused to achieve the efficient ejection of the liquid from the ejection opening.

In accordance with the liquid ejector of the third aspect of the present invention, the acoustic waves are effectively focused at the ejection opening in an in-phase condition in particular when the acoustic waves are introduced into the liquid in planar form.

The liquid ejector of the fourth aspect of the present invention may focus also the acoustic waves having paths in different planes.

The liquid ejector of the fifth aspect of the present invention may comprise a plurality of reservoirs arranged so that the planes are in abutting relationship. As compared with a structure wherein the reflecting wall is defined only by a paraboloidal surface, the structure of the fifth aspect may provide a greater reservoir dimension in a direction in which the paraboloids of revolution are arranged, to reduce the loss of the acoustic energy of the liquid and to increase the degree of integration of the reservoirs.

The liquid ejector of the sixth aspect of the present invention provides the flexibility of the form of the ejection of the liquid in the second direction while achieving the focusing of the acoustic waves in cross section perpendicular to the second direction.

In accordance with the liquid ejector of the seventh aspect of the present invention, the acoustic waves introduced from the recess propagate through the liquid while being focused. Thus, the reflecting wall contributes to the focusing of the acoustic waves in the third direction, and the recess contributes to the focusing of the acoustic waves in the second direction.

In accordance with the liquid ejector of the eighth aspect of the present invention, the acoustic waves are effectively focused at the ejection opening in an in-phase condition in particular when the acoustic waves are introduced radially into the liquid.

The liquid ejector of the ninth aspect of the present invention avoids the corrosion of an electrode required to drive the vibrator by the liquid since the electrode is not in direct contact with the liquid. In particular, the independent ejection of the droplets in a plurality of positions requires a plurality of independently controlled vibrators, and the liquid does not leak from the reservoir if the vibrators are spaced apart from each other.

The liquid ejector of the tenth aspect of the present invention provides acoustic impedance matching between the liquid and the vibrator to efficiently introduce the acoustic waves into the liquid.

The ejection opening is positioned at the focal point of the parabola defined by the reflecting wall in cross section. Thus, the dimension of the ejection opening is sometimes determined by the configuration of the parabola and also varies depending upon the diameter of the focal spot of the acoustic waves.

The liquid ejector of the eleventh aspect of the present invention wherein the diameter of the opening of the nozzle plate is smaller than that of the ejection opening, may control the diameter of the droplets independently of the configuration of the parabola and the diameter of the focal spot of the acoustic waves.

The liquid ejector of the twelfth aspect of the present invention allows the plurality of ejection openings to be readily formed integrally, simplifying the mechanism for introducing the liquid.

The printer apparatus in accordance with the thirteenth aspect of the present invention employs the liquid ejector which efficiently utilizes energy for printing, thereby reducing energy consumption.

It is therefore an object of the present invention to provide a liquid ejector which has an ejection opening spaced apart from an acoustic wave source and which focuses acoustic waves by reflection to increase the density of acoustic energy, thereby efficiently ejecting droplets.

These and other objects, features, aspects and advantages of the present invention will become more apparent from the following detailed description of the present invention when taken in conjunction with the accompanying drawings.

DESCRIPTION OF THE PREFERRED EMBODIMENTS

First Preferred Embodiment

Figure 1:
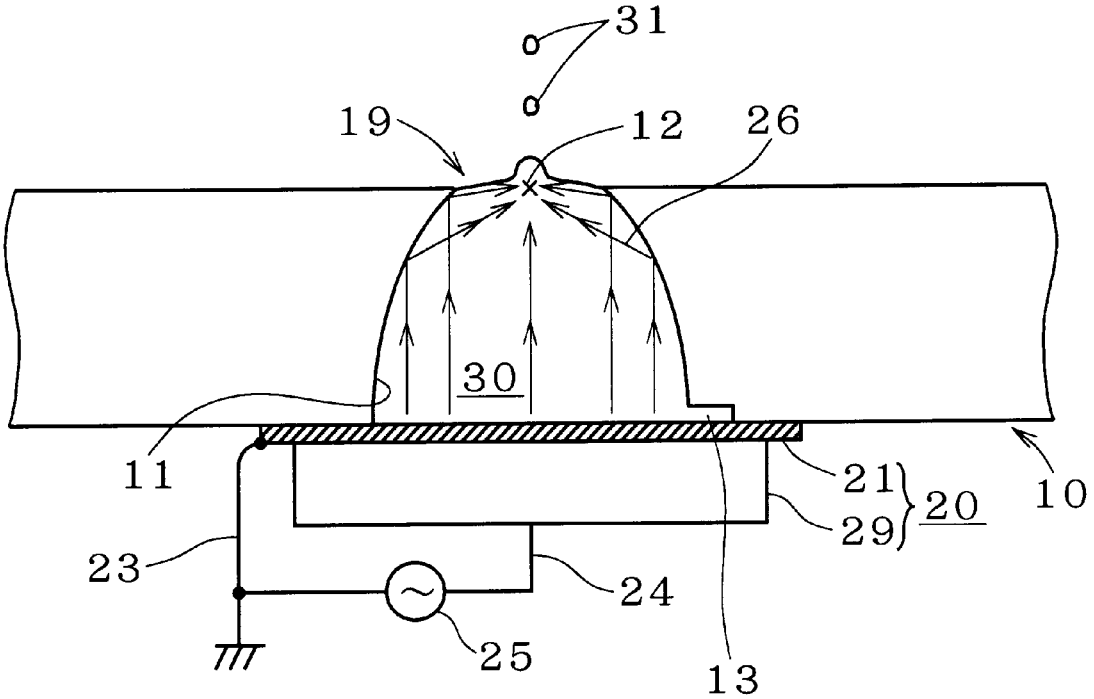
FIG. 1 is a sectional view of a printer head according to a first preferred embodiment of the present invention.

FIG. 1 is a sectional view of a head for use in an ink jet printer according to a first preferred embodiment of the present invention. The head comprises an ink tank 10, and a piezoelectric transducer 20 located on the bottom surface of the ink tank 10.

The ink tank 10 has a cavity for storing ink 30 therein. The inner wall of the cavity serves as a reflecting wall 11. An ejection opening 19 for ejecting the ink 30 is located in the upper surface of the cavity of the ink tank 10 in spaced apart relationship from the bottom surface on which the piezoelectric transducer 20 is provided.

The piezoelectric transducer 20 comprises an electrode 21 and a piezoelectric vibrator 29 which are connected to interconnect lines 23 and 24, respectively. The interconnect lines 23 and 24 are connected to an alternating-current power supply 25. The electrode 21 establishes an electrical connection to the piezoelectric vibrator 29, and backs the cavity from below the bottom surface to prevent the ink 30 from leaking.

Substantially planar acoustic waves 26 are introduced from the piezoelectric transducer 20 into the ink 30 and are then reflected from the reflecting wall 11. The reflecting wall 11 defines a parabola in cross section shown in FIG. 1, and the ejection opening 19 is located adjacent the focal point 12 of the parabola. Thus, the acoustic waves 26 come to focus at the ejection opening 19 to increase the density of the acoustic energy in the ink 30 in the ejection opening 19, achieving the emission of ink droplets 31 from the ejection opening 19.

Figure 2:
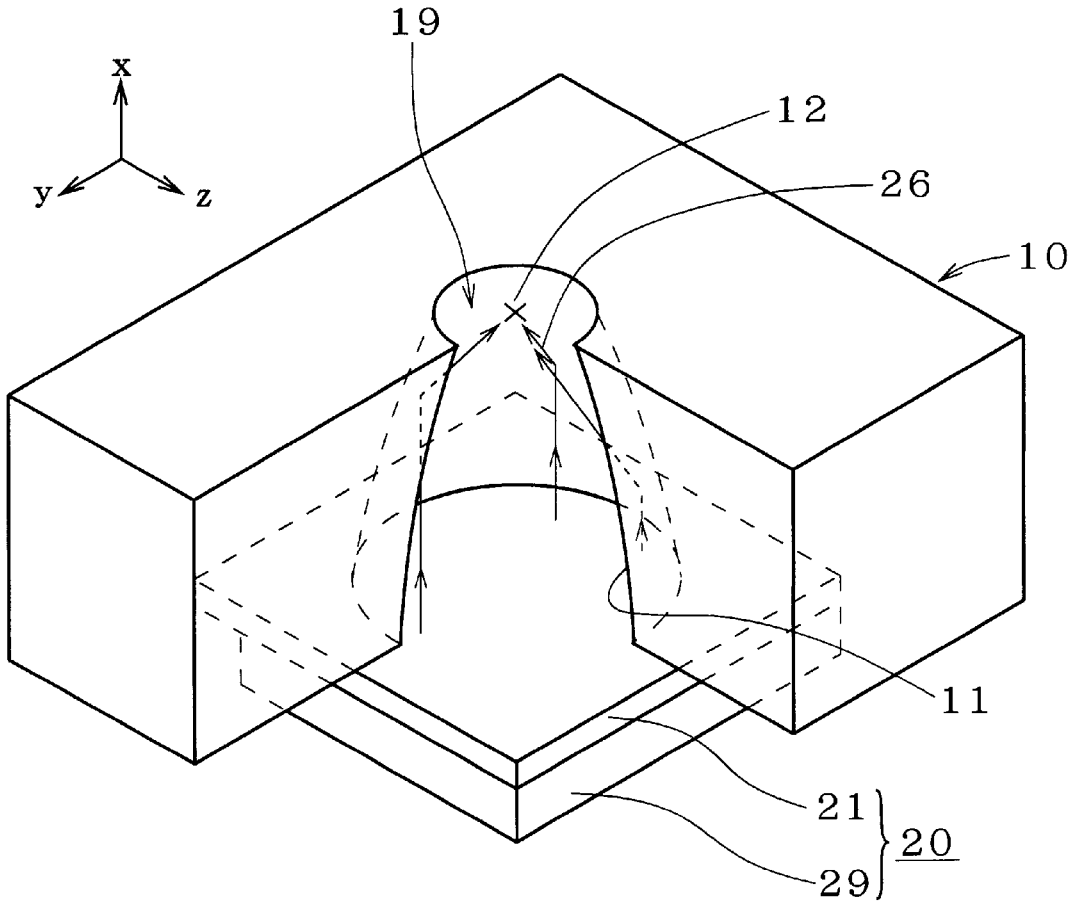
FIG. 2 is a perspective view, with parts broken away, of the head of the first preferred embodiment.

An example of the reflecting wall 11 of the parabolic sectional configuration includes the reflecting wall 11 in the shape of a paraboloid of revolution. FIG. 2 is a perspective view, with parts broken away, of the head including the reflecting wall 11 in the shape of the paraboloid of revolution. For purposes of illustration, the interconnect lines 23, 24, the alternating-current power supply 25, the ink 30, and the ink droplets 31 are not shown in FIG. 2. The central axis of the paraboloid of revolution is shown in FIG. 2 as being parallel to the x direction in which the acoustic waves 26 are introduced into the ink 30.

The head constructed as above described solves all of the background art drawbacks (1) to (5). The reasons therefor will be discussed below.

(1) The size of the ejection opening 19 which is defined only by the ink tank 10 in separate relation to the piezoelectric transducer 20 may be controlled with high accuracy.

(2) Since the ejection opening 19 is spaced apart from the piezoelectric transducer 20, the vibration of the piezoelectric transducer 20 does not interfere with the acoustic waves 26 focused at the ejection opening 19.

(3) The electrode 21 which is closer to the ink 30 relative to the piezoelectric transducer 20, backing the bottom surface of the ink tank 10 is easy to connect to the interconnect line 23.

(4) An intake passage 13 for supplying the ink 30 is provided in the bottom of the cavity for storing the ink 30. The reflecting wall 11 adjacent to the bottom does not significantly contribute to the reflection of the acoustic waves 26. Thus, the intake passage 13 provided in the bottom of the cavity exerts small adverse effects on the focusing of the acoustic waves 26.

(5) The traveling acoustic waves 26 always have components oriented in the positive x direction and no components oriented in the negative x direction. Then, the paths of the acoustic waves 26 are reflected at obtuse angles from the reflecting wall 11, and a small amount of acoustic energy is lost when the acoustic waves 26 are reflected from the reflecting wall 11.

Figure 3:
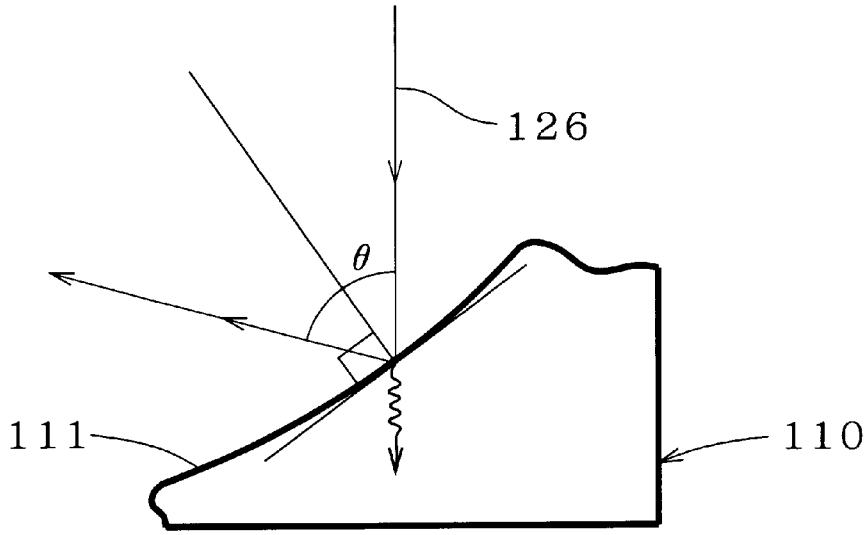
FIG. 3 is a sectional view showing an acoustic wave reflected from a reflecting surface.
Figure 4:
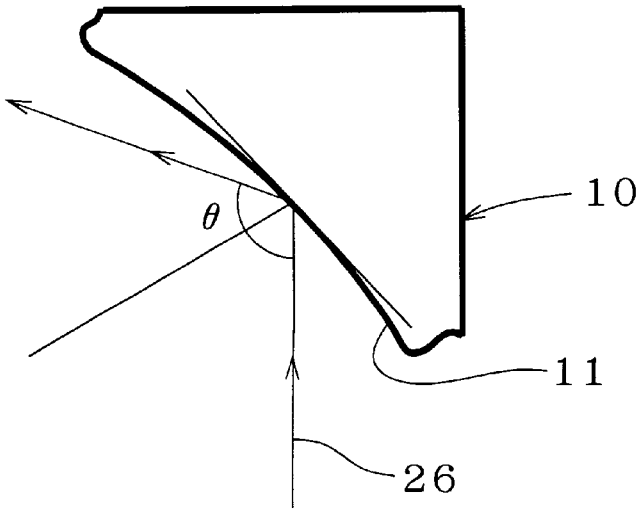
FIG. 4 is a sectional view showing an acoustic wave reflected from a reflecting wall.
Figure 19:
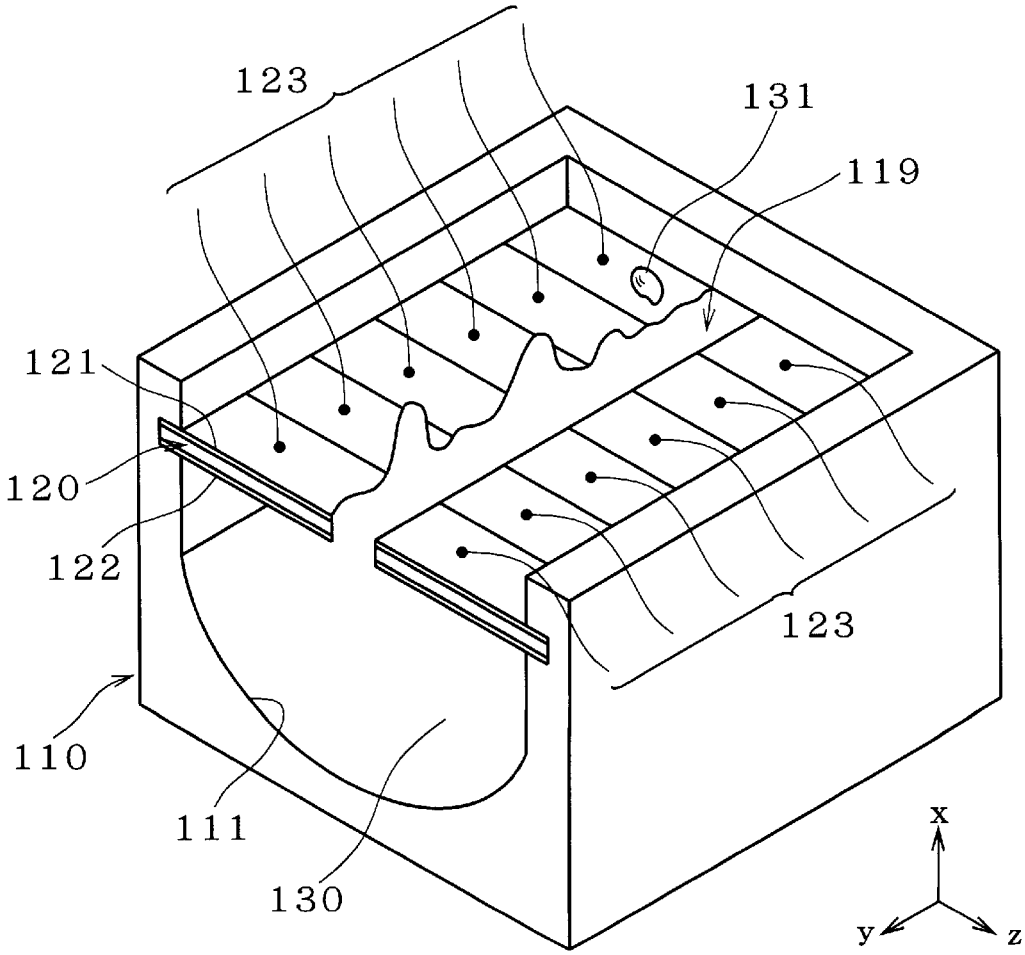
FIG. 19 is a cutaway view in perspective of a conventional ink jet printer head.
Figure 20:
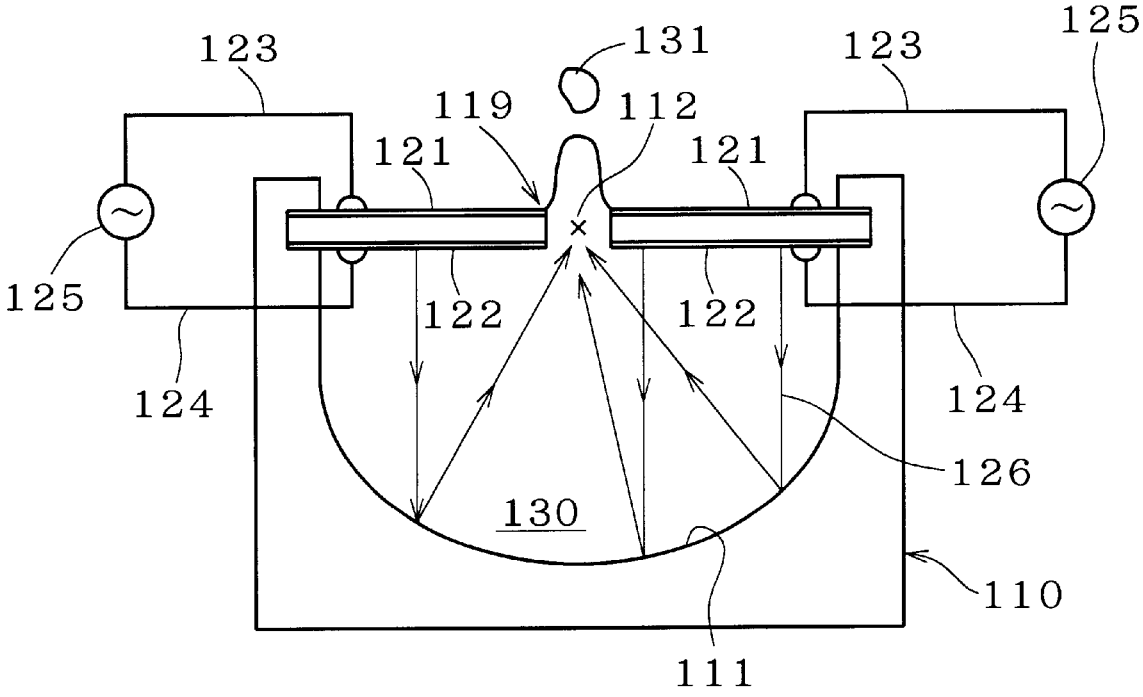
FIG. 20 is a sectional view taken along the xz plane of FIG. 19.

For illustration of the reason (5) in greater detail, FIG. 3 shows an acoustic wave 126 reflected from the reflecting surface 111 of FIG. 19 in cross section, and FIG. 4 shows an acoustic wave 26 reflected from the reflecting wall 11 of FIG. 1 in cross section.

The sum θ of the incidence angle of the acoustic wave and the reflection angle thereof is less than 90 degrees with reference to FIG. 3, but is greater than 90 degrees with reference to FIG. 4. This results from the positional relationship between the ejection opening, the piezoelectric transducer, and the reflecting surface (or wall). In the case of FIG. 3 (i.e., in the structure shown in FIG. 19), since the ejection opening 119 and the piezoelectric transducers 120 are on the same side relative to the reflecting surface 111, the parabola defined by the reflecting surface 111 in cross section must be used in positions closer to the vertex thereof than to the focal point 112 thereof. On the other hand, in the case of FIG. 4 (i.e., in the structure shown in FIG. 1), since the ejection opening 19 and the piezoelectric transducer 20 are on opposite sides relative to the reflecting wall 11, the parabola defined by the reflecting wall 11 in cross section is used in positions farther from the vertex thereof than from the focal point 12.

Figure 5:
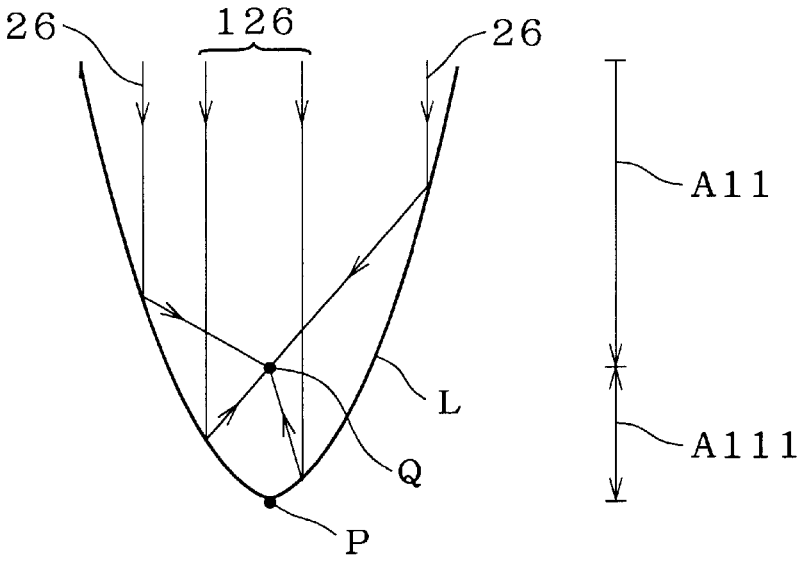
FIG. 5 is a graph illustrating effects of the first preferred embodiment.

FIG. 5 is a graph showing a parabola L and the relationship between the focal point Q and vertex P thereof. The parabola L in a region A111 is that defined by the reflecting surface 111 in cross section, and the parabola L in a region A11 is that defined by the reflecting wall 11 in cross section.

Such a difference between the angle θ greater than 90 degrees and the angle θ less than 90 degrees influences the amount of acoustic energy lost during the reflection of the acoustic waves. Since the acoustic waves traveling in the liquid vibrate longitudinally, a large amount of acoustic energy leaks into the ink tank 110 as indicated by the wiggly arrow of FIG. 3 if the angle θ is less than 90 degrees. On the other hand, a small amount of acoustic energy leaks into the ink tank 10 if the angle θ is greater than 90 degrees. Consequently, the structure shown in FIG. 1 has an advantage over the structure shown in FIG. 19 in that it causes a smaller loss of energy.

The piezoelectric vibrator 29 for the practice of this invention is preferably made of a material having low expansion and contraction properties in a plane (the yz plane in FIG. 2) orthogonal to the direction of the vibration when the thickness-longitudinal vibration is developed. The reason therefor is that the piezoelectric vibrator 29 having a periphery fixed by the bottom surface of the ink tank 10 is not permitted to expand or contract, and thus a material having high expansion and contraction properties is not efficiently excited into thickness-longitudinal vibration.

Second Preferred Embodiment

Figure 6:
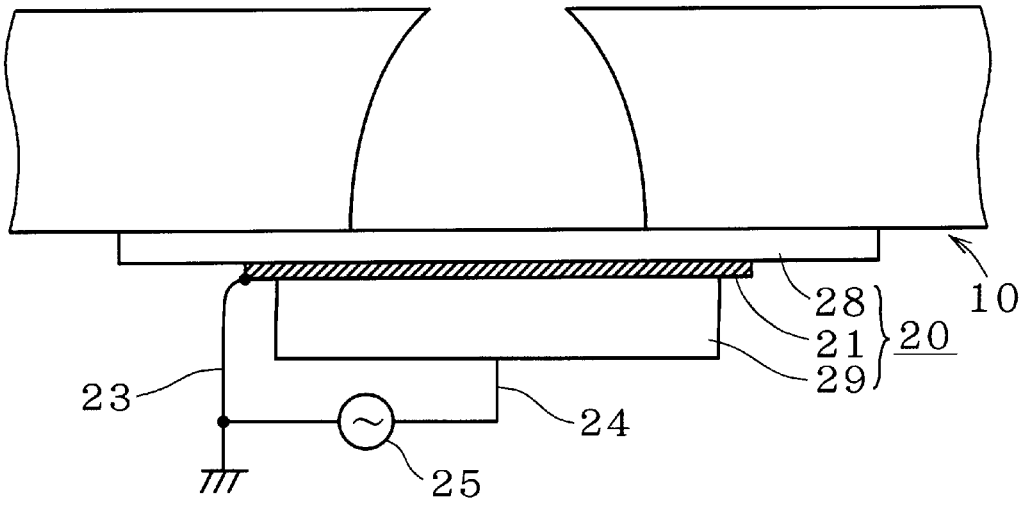
FIG. 6 is a sectional view of the head according to a second preferred embodiment of the present invention.

FIG. 6 is a sectional view of the head for use in an ink jet printer according to a second preferred embodiment of the present invention. The head of the second preferred embodiment differs from that of the first preferred embodiment in that the piezoelectric transducer 20 further comprises a vibrating plate 28 between the electrode 21 and the ink tank 10.

The vibrating plate 28 provided in this fashion precludes the electrode 21 from directly contacting the ink 30 to avoid the corrosion of the electrode 21 by the ink 30. The vibrating plate 28 also functions to reinforce the ink tank 10 adjacent the cavity where the strength thereof might be lower.

Additionally, the vibrating plate 28 has an acoustic impedance which may be set to an intermediate level between the acoustic impedance of the ink 30 and the acoustic impedance of the electrode 21 and piezoelectric vibrator 29. This allows the matching of the acoustic impedances of the piezoelectric vibrator 29 and the ink 30, achieving the efficient introduction of the acoustic waves 26 into the ink 30.

Third Preferred Embodiment

Figure 7:
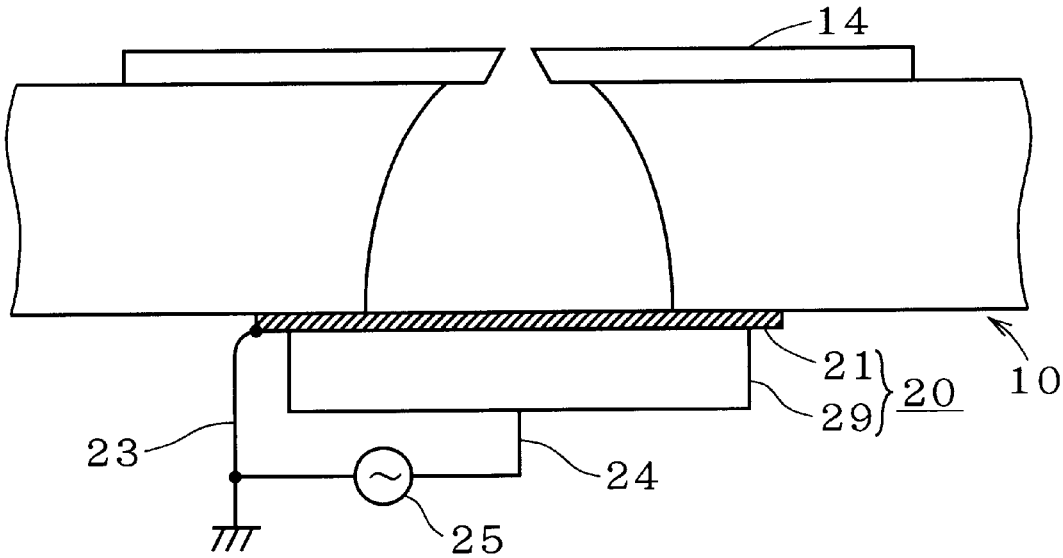
FIG. 7 is a sectional view of the head according to a third preferred embodiment of the present invention.

FIG. 7 is a sectional view of the head for use in an ink jet printer according to a third preferred embodiment of the present invention. The head of the third preferred embodiment differs from that of the first preferred embodiment in that a nozzle plate 14 having an opening on the ejection opening 19 is provided on the top surface of the ink tank 10.

The size of the ejection opening 19 required to be located at the focal point 12 of the parabola defined by the reflecting wall 11 in cross section sometimes varies depending upon the configuration of the parabola and also upon the diameter of the focal spot of the acoustic waves 26. However, the nozzle plate 14 provided in this manner may control the size of the ink droplets 31 independently of the dimensions of the parabola and the diameter of the focal spot of the acoustic waves 26, also allowing the ejection of a spray of atomized ink 30.

In practice, the third preferred embodiment is considered to be effective when the diameter of the opening of the nozzle plate 14 is smaller than that of the ejection opening 19. The nozzle plate 14 may be, of course, formed integrally with the ink tank 10.

Fourth Preferred Embodiment

The structure of the first to third preferred embodiments may be applied to a head having a plurality of ejection openings 19 provided for the single ink tank 10.

Figure 8:
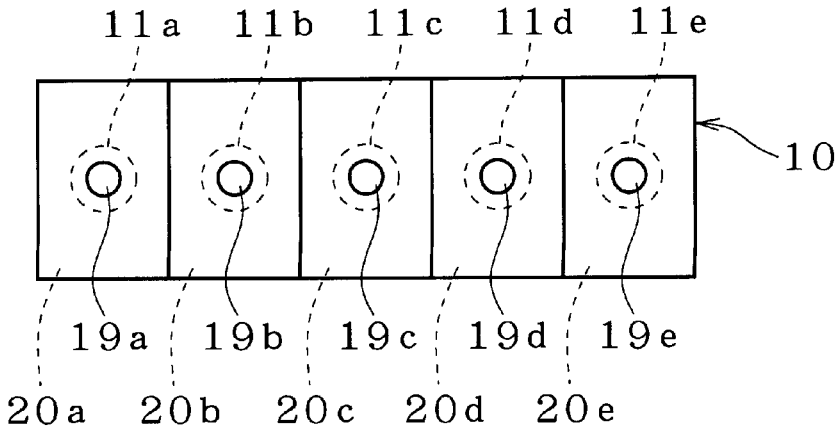
FIGS. 8 and 9 are plan views of the head according to a fourth preferred embodiment of the present invention.

FIG. 8 is a plan view of the head including a plurality of ejection openings 19*a* to 19*e* arranged in a row for the single ink tank 10. A plurality of independently driven piezoelectric transducers 20*a* to 20*e* are provided in corresponding relation to the ejection openings 19*a* to 19*e*, respectively (although the interconnect lines 23, 24 and the alternating-current power supply 25 are not shown in FIG. 8 for purposes of simplification).

In this manner, the independent ejection of the ink droplets 31 at a plurality of positions requires the plurality of independently controlled piezoelectric transducers 20*a* to 20*e*. In such a case, the single vibrating plate 28 as described in the second preferred embodiment may be commonly provided for all of the ejection openings 19*a* to 19*e* to readily prevent the leakage of the ink 30. Since reflecting walls 11a to lie corresponding respectively to the ejection openings 19*a* to 19*e* are not coupled to each other, the vibrating plate 28 is fixed on the bottom surface of the ink tank 10 between adjacent ones of the piezoelectric transducers 20*a* to 20*e* to suppress the interference between the vibrations of adjacent ones of the piezoelectric transducers 20*a* to 20*e*.

Figure 9:
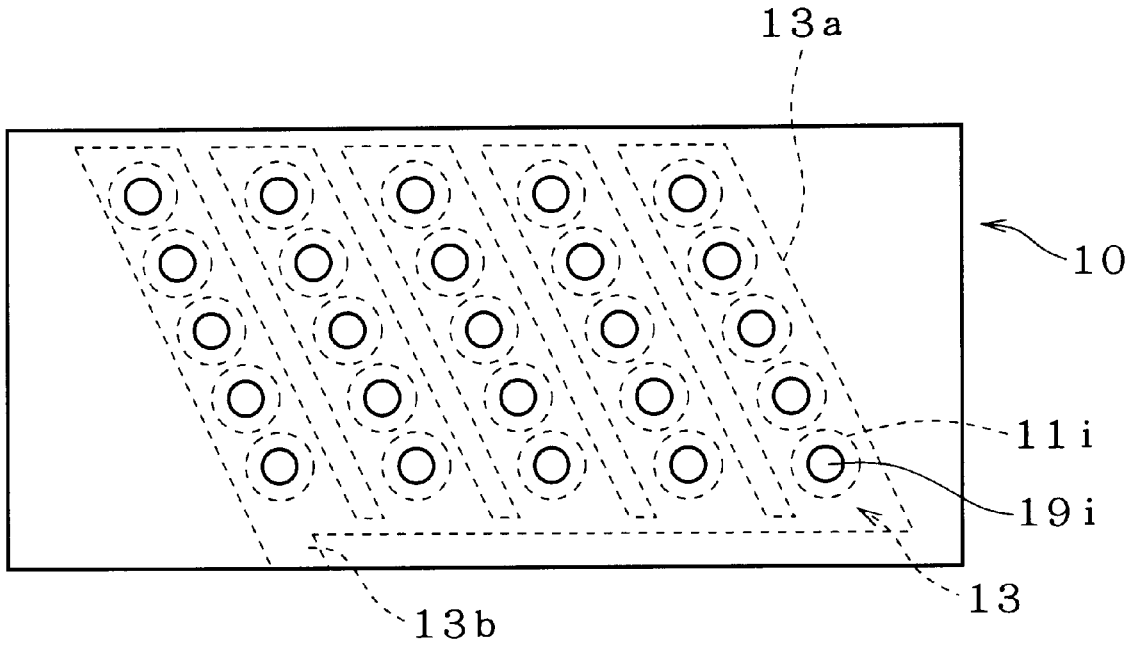

FIG. 9 is a plan view of the head including a plurality of ejection openings 19*i* arranged in a matrix for the single ink tank 10. The intake passage 13 may comprise sections 13*a* provided for respective columns of the ejection openings 19*i*, and a supply inlet 13*b* for supplying the ink 30 to the sections 13*a*.

The formation of the plurality of ejection openings 19*i* for the single ink tank 10 facilitates fabricating steps and simplifies the mechanism for supplying the ink 30.

Fifth Preferred Embodiment

Figure 10:
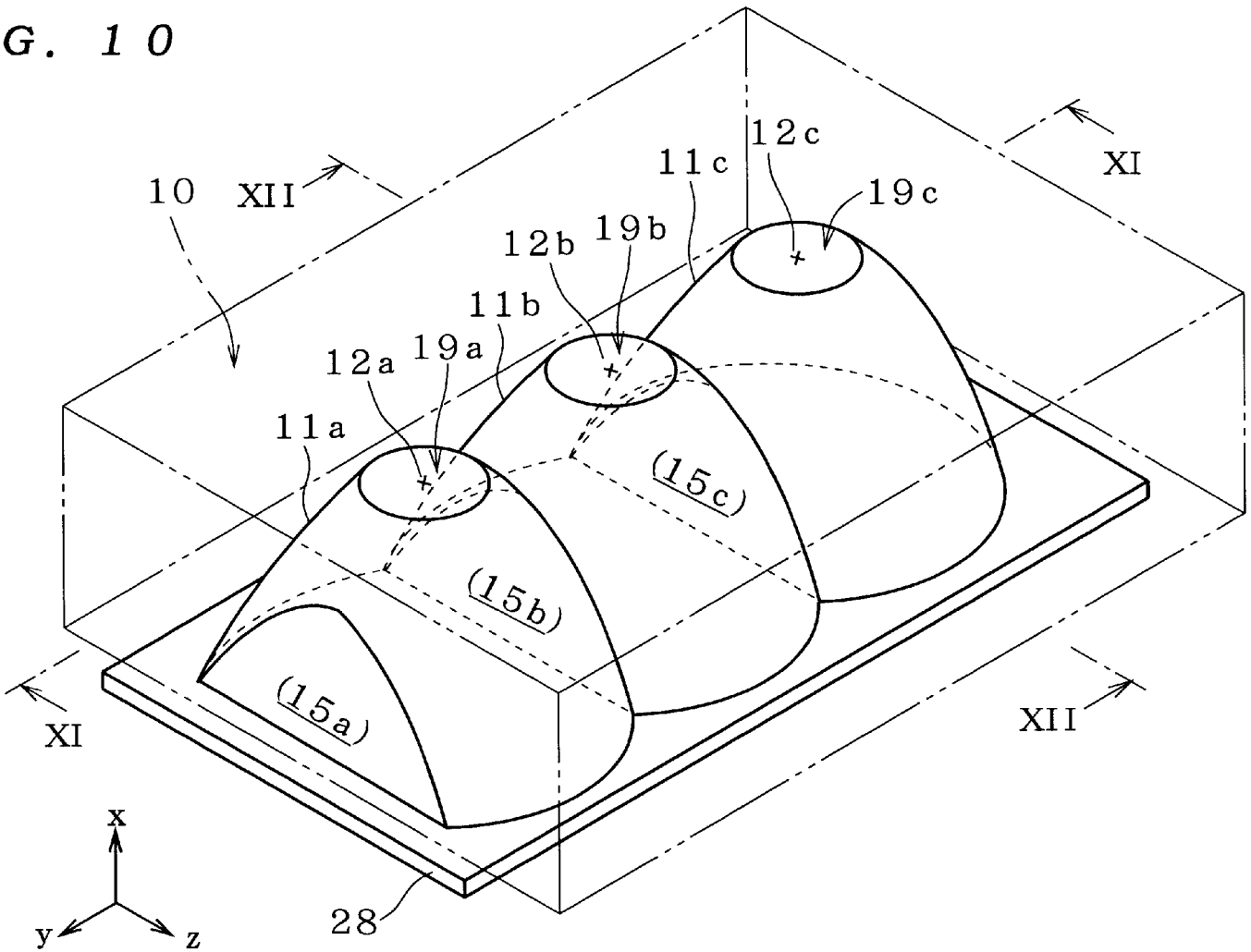
FIG. 10 is a perspective view of the head according to a fifth preferred embodiment of the present invention.

FIG. 10 is a perspective view of the head for use in an ink jet printer according to a fifth preferred embodiment of the present invention. For clarity of the configuration of the reflecting wall, the contour of the ink tank 10 is indicated by alternate long and two short dashes lines, and the configuration of the cavity is indicated by solid and broken lines or curves. For proper illustration, portions of the ink tank 10 indicated by the alternate long and two short dashes lines of FIG. 10 should be indicated by solid lines, and portions of the ink tank 10 indicated by the solid and broken lines and curves of FIG. 10 should be indicated by broken lines and curves. The types of the lines and curves of FIG. 10 are adopted to clarify the relation indicated by the solid and broken lines and curves of FIG. 10, that is, which parts of the cavity are on the front side or the rear side. Although the vibrating plate 28 is indicated by the solid lines, the piezoelectric vibrators and the electrodes thereof are not shown for purposes of simplification.

Figure 11:
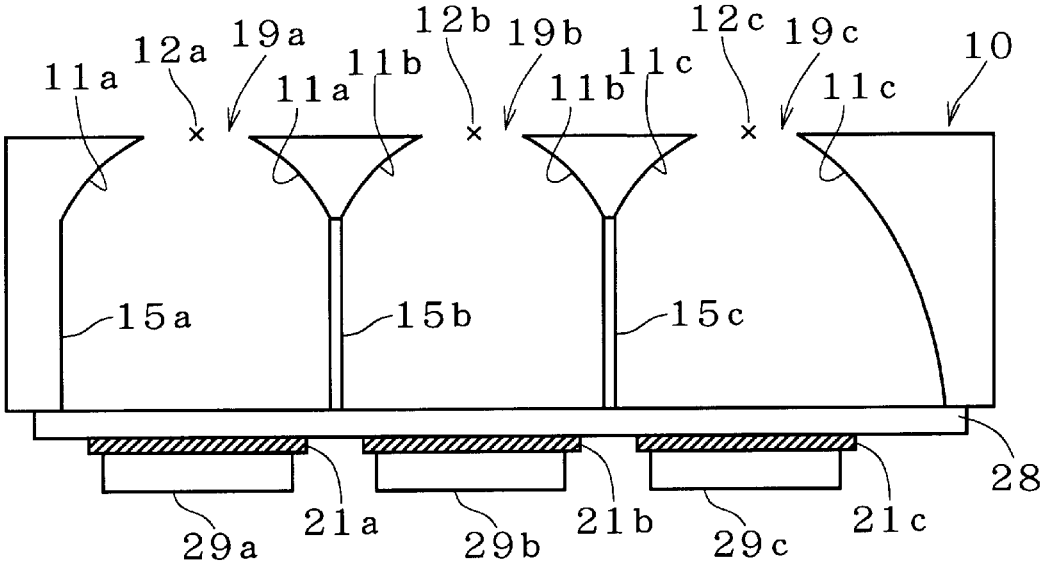
FIG. 11 is a sectional view taken along the line XI—XI of FIG. 10.
Figure 12:
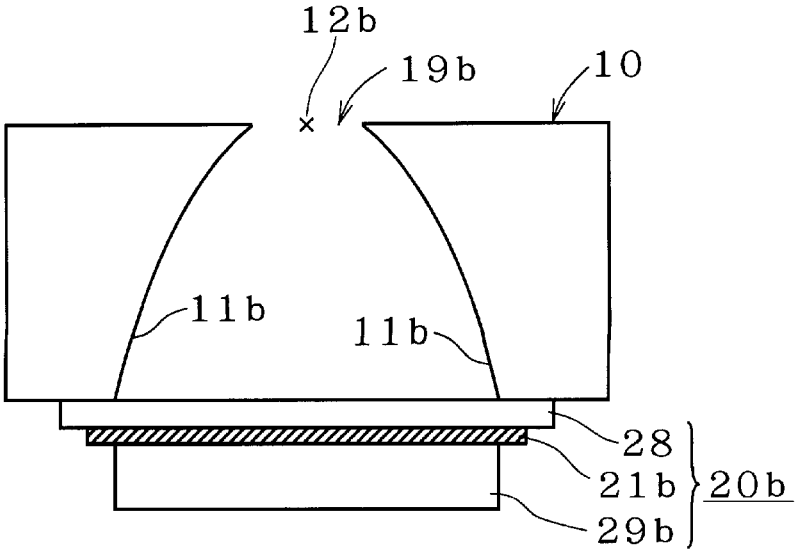
FIG. 12 is a sectional view taken along the line XII—XII of FIG. 10.

FIG. 11 is a sectional view taken along the line XI—XI of FIG. 10, and FIG. 12 is a sectional view taken along the line XII—XII of FIG. 10. In these sections, the piezoelectric vibrators and the electrodes thereof are illustrated, but the interconnect lines and the alternating-current power supply which are a mechanism for electrically driving the piezoelectric vibrators and the electrodes are not shown.

The ink tank 10 comprises the plurality of ejection openings 19*a* to 19*c* arranged in a row. Piezoelectric vibrators 29*a* to 29*c* and electrodes 21*a* to 21*c* corresponding respectively to the ejection openings 19*a* to 19*c* are located on the bottom surface of the vibrating plate 28 which is located on the bottom surface of the ink tank 10. The advantages of the vibrating plate 28 in the case where the plurality of ejection openings 19*a* to 19*c* are provided have been described in the fourth preferred embodiment.

The reflecting wall 11*a* defines part of a paraboloid of revolution having an axis of revolution parallel to the X direction, that is, the direction in which the piezoelectric vibrator 29*a* introduces acoustic waves. The ejection opening 19*a* is positioned at the focal point 12*a* of the paraboloid. It should be noted that a cavity associated with the ejection opening 19*a* is defined not only by the reflecting wall 11*a* but also by partitioning surfaces 15*a* and 15*b* parallel to the xz plane. Likewise, the reflecting walls 11*b* and 11*c* define respective parts of paraboloids of revolution having axes of revolution extending in the x direction, and the ejection openings 19*b* and 19*c* are positioned at the focal points 12*b* and 12*c* of the paraboloids, respectively. A cavity associated with the ejection opening 19*b* is defined by the reflecting wall 11*b* and partitioning surfaces 15*b* and 15*c*.

The cavities each having a pair of partitioning surfaces opposed in the y direction are arranged in abutting relation in the y direction to increase the density of the ejection openings in the y direction. Such an increase in positioning density of the ejection openings desirably enhances the printing precision of a printer employing this head. The reflecting walls, similar to the reflecting wall of the first preferred embodiment, bring the acoustic waves to focus at the ejection openings, respectively.

Preferably, the partitioning surfaces 15*a* to 15*c* in the fifth preferred embodiment are made of a material which absorbs the acoustic waves to avoid interference between the acoustic waves produced by adjacent ones of the piezoelectric vibrators 29*a* to 29*c*. The need for the partitioning surfaces is eliminated if the acoustic waves are ideally introduced only in the x direction.

The ejection opening 19*c* in the end position of the row needs no partitioning surface on the end of the row. Specifically, the cavity associated with the ejection opening 19*c* is required to be defined only by the reflecting wall 11*c* and the single partitioning surface 15*c*. Of course, the pair of partitioning surfaces 15*a* and 15*b* may be employed for the ejection opening in the end position of the row, such as the ejection opening 19*a*.

The cavities having the above described structure may further have a pair of partitioning surfaces opposed in the z direction to increase the positioning density of the ejection openings also in the z direction.

Sixth Preferred Embodiment

Figure 13:
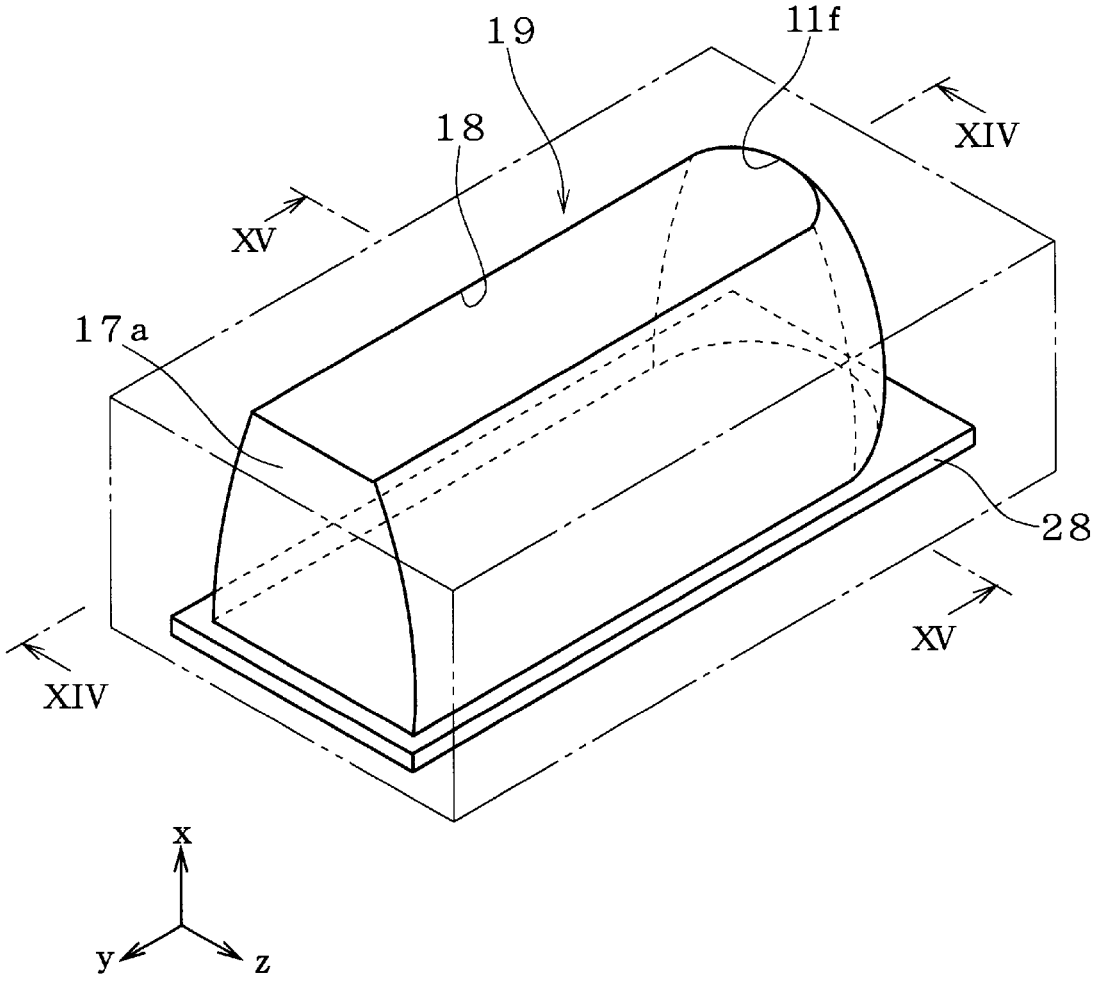
FIG. 13 is a perspective view of the head according to a sixth preferred embodiment of the present invention.

FIG. 13 is a perspective view of the head for use in an ink jet printer according to a sixth preferred embodiment of the present invention. For clarity of the configuration of the reflecting wall, the types of lines and curves are changed in the same manner as those in the fifth preferred embodiment, and the piezoelectric vibrators and the electrodes thereof are not shown in FIG. 13 although the vibrating plate 28 is indicated by the solid lines.

Figure 14:
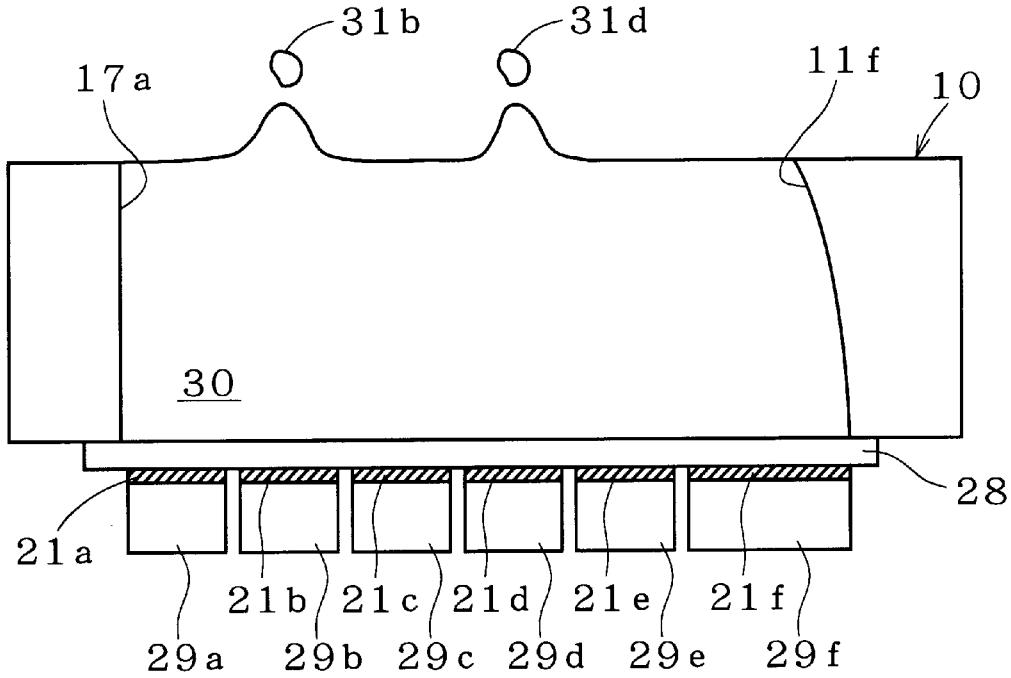
FIG. 14 is a sectional view taken along the line XIV—XIV of FIG. 13.
Figure 15:
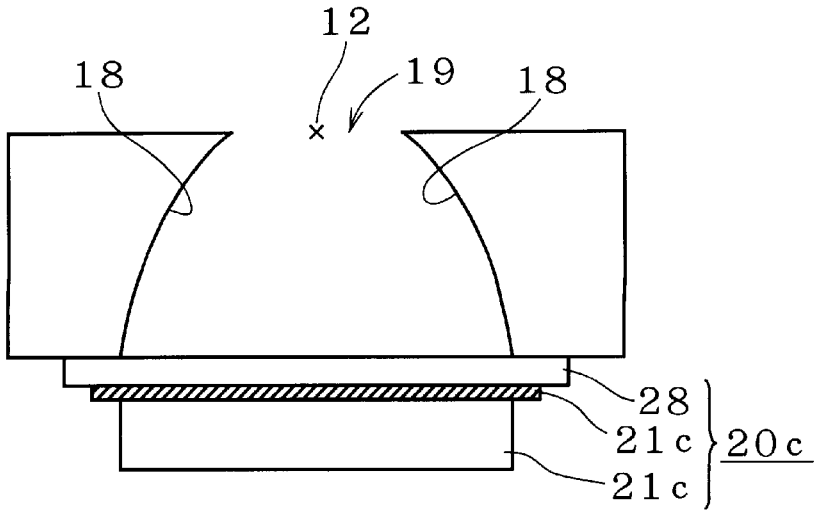
FIG. 15 is a sectional view taken along the line XV—XV of FIG. 13.

FIG. 14 is a sectional view taken along the line XIV—XIV of FIG. 13, and FIG. 15 is a sectional view taken along the line XV—XV of FIG. 13. In these sections, the interconnect lines and the alternating-current power supply are not shown, as in the fifth preferred embodiment.

The ink tank 10 comprises the single ejection opening 19 extending in the y direction. Piezoelectric vibrators 29*a* to 29*f* and electrodes 21*a* to 21*f* are arranged in the y direction on the bottom surface of the vibrating plate 28, located on the bottom surface of the ink tank 10.

A reflecting wall 18 defines a parabola in cross section taken along the xz plane, and the ejection opening 19 is positioned at the focal point 12 of the parabola. Because of the configuration of the reflecting wall 18, a multiplicity of focal points 12 arranged in the y direction are present. A reflecting wall 11*f* defines part of a paraboloid of revolution having an axis of revolution extending in the x direction, and a parabola defined by the reflecting wall 11*f* in cross section is identical with the parabola defined by the reflecting wall 18 in cross section taken along the xz plane.

The sixth preferred embodiment may be regarded as the structure of the fifth preferred embodiment subjected to extreme integration in the y direction. Thus, the parabolic configuration appears only in the xz plane, and the acoustic waves are focused by the reflecting wall 18 only in the xz plane. In the structure described in the first to fifth preferred embodiments, on the other hand, the acoustic waves are focused also in other planes parallel to the x-axis.

The piezoelectric vibrators 29*a* to 29*f* arranged in the y direction may be independently driven to eject, for example, ink droplets 31*b* and 31*d* at different positions on the y-axis.

At an end of the ejection opening 19 may be provided a surface parallel to the xz plane such as a partitioning surface 17*a* or a paraboloidal surface such as the reflecting wall 11*f*. If the reflecting wall 11*f* is employed, the acoustic waves may be focused in various planes parallel to the x-axis at the end.

Seventh Preferred Embodiment

Figure 16:
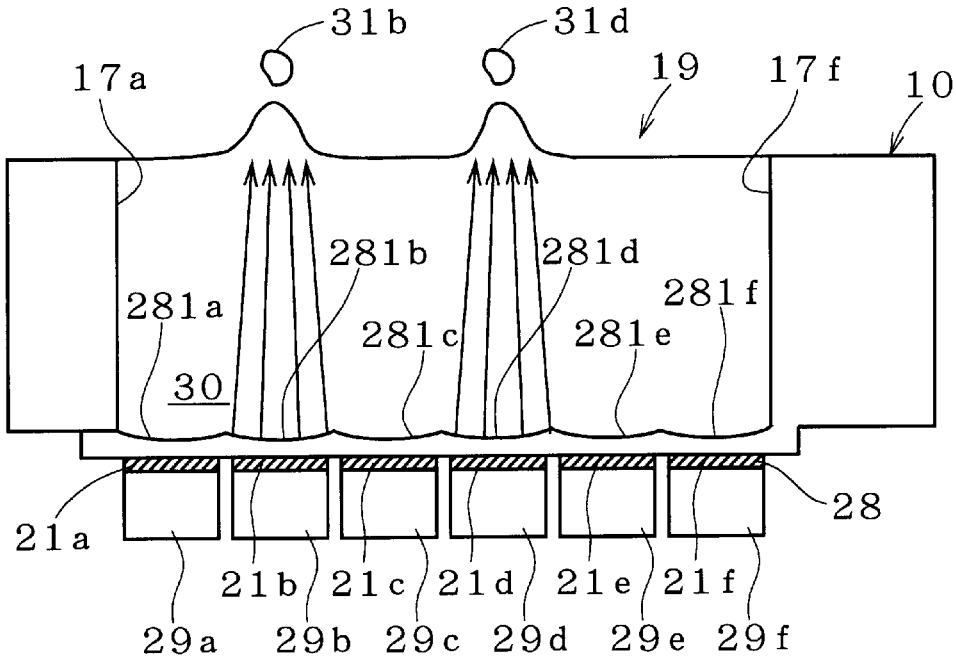
FIG. 16 is a sectional view of the head according to a seventh preferred embodiment of the present invention.

FIG. 16 is a sectional view of the head for use in an ink jet printer according to a seventh preferred embodiment of the present invention, and corresponds to FIG. 14. The head of the seventh preferred embodiment differs from that of the sixth preferred embodiment in that partitioning surfaces 17*a* and that 17*f* parallel to the xz plane are provided on opposite ends of the ejection opening 19 and that the surface of the vibrating plate 28 which is closer to the ink tank 10, in cross section taken along the xy plane, includes recessed surfaces 281*a* to 281*f* corresponding respectively to the piezoelectric vibrators 29*a* to 29*f*.

The recessed surfaces 281*a* to 281*f* are effective in bringing the acoustic waves 26 to focus in the xy plane toward the ejection opening 19. This allows the acoustic waves to be focused not only in the direction of focusing of the acoustic waves illustrated in the sixth preferred embodiment but also in a direction orthogonal thereto, thereby further increasing the density of the acoustic energy.

Such a structure minimizes the need to provide the reflecting wall 11*f* which is, in particular, a paraboloidal surface on the end portion, and is required only to provide the partitioning surface 17*f* which is planar. This also advantageously simplifies the structure.

Eighth Preferred Embodiment

Figure 17:
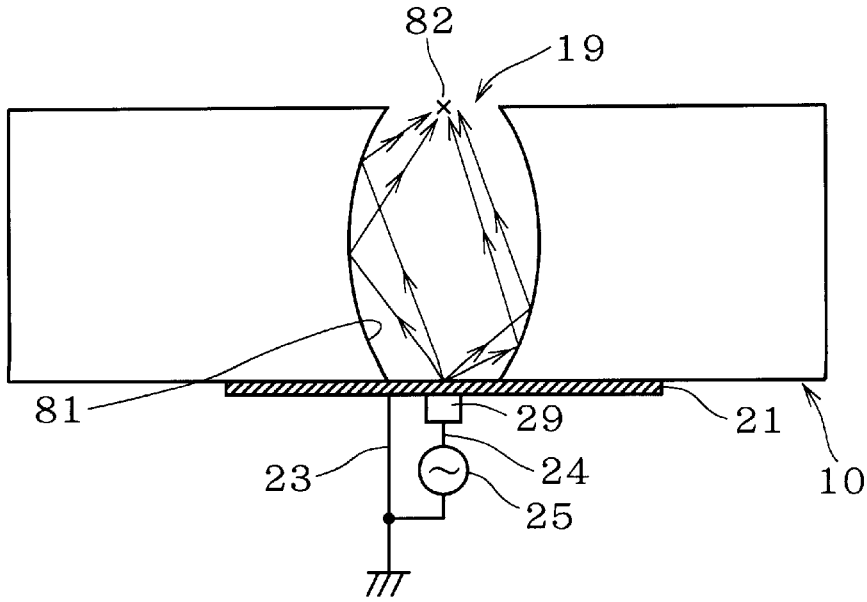
FIG. 17 is a sectional view of the head according to an eighth preferred embodiment of the present invention.

FIG. 17 is a sectional view of the head for use in an ink jet printer according to an eighth preferred embodiment of the present invention. The ink tank 10 comprises a reflecting wall 81 that defines arcs of an ellipse in cross section. The piezoelectric vibrator 29 serving as a point source for generating acoustic waves is located in the bottom of the ink tank 10.

The ellipse has a major axis extending parallel to the thickness direction of the ink tank 10. The ejection opening 19 is positioned at one focal point 82 of the ellipse, and the piezoelectric vibrator 29 is positioned at the other focal point thereof.

When the mechanism for introducing the acoustic waves emits the acoustic waves radially into the ink, in this eighth preferred embodiment, this mechanism and the ejection opening may be located respectively at the two focal points of the ellipse to focus the acoustic waves at the ejection opening.

Ninth Preferred Embodiment (Application to Printer Apparatus)

Figure 18:
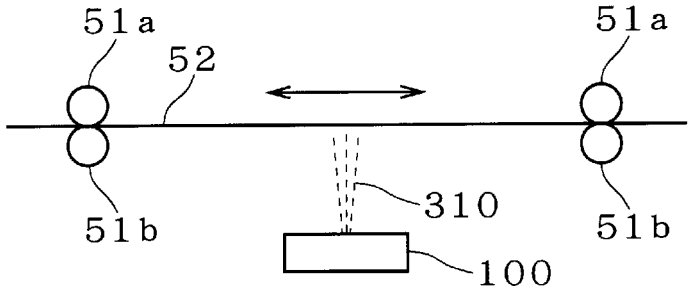
FIG. 18 conceptually illustrates a structure of a printer using the head.

FIG. 18 conceptually illustrates a structure of a printer apparatus employing a head 100. Paper 52 on which information is to be printed moves in the directions of the arrows of FIG. 18 in opposed relation to the head 100. This movement is accomplished by the rotation of a pair of upper rollers 51*a* located on the opposite side of the paper 52 from the head 100 and a pair of lower rollers 51*b* located on the same side of the paper 52 as the head 100, with the paper 52 held between the upper rollers 51*a* and the lower rollers 51*b*.

While the paper 52 is being moved, a stream 310 of droplets is ejected from the head 100 at desired time intervals to print a desired line relative to the direction of the movement of the paper 52. Two-dimensional printing is achieved by the movement of the paper 52 when the ejection opening 19, for example, shown in FIG. 13 is disposed, with the y-axis oriented in a direction perpendicular to the plane of FIG. 18. The head 100 may be moved in place of the paper 52.

The use of the head of the first to eighth preferred embodiments as the head 100 permits efficient ejection of the droplets, achieving the printer apparatus with reduced power consumption.

While the invention has been described in detail, the foregoing description is in all aspects illustrative and not restrictive. It is understood that numerous other modifications and variations can be devised without departing from the scope of the invention.

We claim:

1. A liquid ejector comprising:

a reservoir for storing a liquid to be ejected, said reservoir including a reflecting wall and an ejection opening for ejecting the liquid; and a planar acoustic wave source located on and forming part of a wall of said reservoir, spaced apart from the ejection opening, for introducing acoustic waves into the liquid, wherein the acoustic waves introduced from said planar acoustic wave source are reflected from said reflecting wall and focus at the ejection opening.

2. The liquid ejector according to claim 1, wherein the acoustic waves introduced from said planar acoustic wave source are reflected at an angle greater than 90 degrees from said reflecting wall and travel in the liquid toward the ejection opening.

3. The liquid ejector according to claim 2, wherein at least part of said reflecting wall defines, in cross section, a parabola having an axis parallel to a first direction perpendicular to said planar acoustic wave source and extending to the ejection opening, and the ejection opening is positioned at the focal point of the parabola.

4. The liquid ejector according to claim 3, wherein said reflecting wall defines a paraboloid of revolution having an axis of revolution parallel to the first direction, and the ejection opening is positioned at the focal point of the paraboloid.

5. The liquid ejector according to claim 4, wherein said reservoir further includes a planar surface parallel to the first direction.

6. The liquid ejector according to claim 3, wherein said planar acoustic source extends in a second direction perpendicular to the first direction, and said reflecting wall defines the parabola in a cross section perpendicular to the second direction.

7. The liquid ejector according to claim 6, wherein said planar acoustic wave source defines a recess opposed to the ejection opening in a cross section perpendicular to a third direction perpendicular to both of the first and second directions.

8. The liquid ejector according to claim 1, wherein at least part of said reflecting wall defines an arc of an ellipse in cross section, and said planar acoustic wave source and the ejection opening are positioned at respective, different focal points of the ellipse.

9. A liquid ejector comprising:

a reservoir for storing a liquid to be ejected, said reservoir including a reflecting wall and an ejection opening for ejecting the liquid; and an acoustic wave source located on reservoir, spaced apart from the ejection opening, for introducing acoustic waves into the liquid, wherein said acoustic waves introduced from said acoustic wave source are reflected at an angle greater than 90 degrees from said reflecting wall, and travel in the liquid toward and focus at the ejection opening.

10. The liquid ejector according to claim 9, wherein at least part of said reflecting wall defines, in cross section, a parabola having a focal point and an axis parallel to a first direction perpendicular to said acoustic wave source and extending to the ejection opening, and the ejection opening is positioned at the focal point of the parabola.

11. The liquid ejector according to claim 10, wherein said reflecting wall defines a paraboloid of revolution having a focal point and an axis of revolution parallel to the first direction, and the ejection opening is positioned at the focal point of the paraboloid.

12. The liquid ejector according to claim 11, wherein said reservoir further includes a planar surface parallel to the first direction.

13. The liquid ejector according to claim 10, wherein said acoustic source extends in a second direction perpendicular to the first direction, and said reflecting wall defines the parabola in a cross section perpendicular to the second direction.

14. The liquid ejector according to claim 13, wherein said acoustic wave source defines a recess opposed to the ejection opening in a cross section perpendicular to a third direction perpendicular to both of the first and second directions.

15. The liquid ejector according to claim 10, comprising a nozzle plate including an opening having a diameter less than the diameter of the ejection opening.

16. The liquid ejector according to claim 9, wherein at least part of said reflecting wall defines an arc of an ellipse in cross section, and said acoustic wave source and the ejection opening are positioned at respective, different focal points of the ellipse.

17. The liquid ejector according to claim 9, wherein said acoustic wave source comprises:

a vibrator; and a vibrating plate located between said vibrator and said reservoir.

18. The liquid ejector according to claim 17, wherein said vibrating plate has an acoustic impedance intermediate the acoustic impedance of the liquid and the acoustic impedance of said vibrator.

19. The liquid ejector according to claim 9, comprising an intake passage located adjacent to said acoustic wave source in said reflecting wall for supplying the liquid, and wherein the ejection opening comprises a plurality of ejection openings in said reservoir, and the intake passage is common to the plurality of ejection openings.

20. A printer apparatus comprising:

a liquid ejector including:

a reservoir for storing a liquid to be ejected, said reservoir including a reflecting wall and an ejection opening for ejecting the liquid, and an acoustic wave source located on said reservoir, spaced apart from the ejection opening, for introducing acoustic waves into the liquid, wherein the acoustic waves introduced from said acoustic wave source are reflected at an angle greater than 90 degrees from said reflecting wall and travel in the liquid toward and focus at the ejection opening; and a moving mechanism for moving paper located opposite the ejection opening, wherein the liquid is ejected to print on the paper.

* * * * *